US006997282B1

(12) United States Patent
Sharp et al.

(10) Patent No.: US 6,997,282 B1
(45) Date of Patent: Feb. 14, 2006

(54) ADJUSTABLE LADDER

(76) Inventors: Robert L. Sharp, 1955 12th St., Gering, NE (US) 69341; Judith J. Sharp, 1955 12th St., Gering, NE (US) 69341

( * ) Notice: Subject to any disclaimer, the term of this patent is extended or adjusted under 35 U.S.C. 154(b) by 71 days.

(21) Appl. No.: 10/790,427

(22) Filed: Mar. 2, 2004

(51) Int. Cl.
*E06C 1/00* (2006.01)
*E04G 1/00* (2006.01)
*E04G 3/08* (2006.01)

(52) U.S. Cl. ..... 182/200; 182/165; 182/175; 182/129; 248/188.5; 248/238

(58) Field of Classification Search ..... 182/200–204, 182/165, 166, 172–175, 129, 22–26; D25/64, D25/65; 248/210, 238, 235, 188.2, 188.5, 248/188.8, 188.9
See application file for complete search history.

(56) References Cited

U.S. PATENT DOCUMENTS

| | | | | | |
|---|---|---|---|---|---|
| 55,288 | A | * | 6/1866 | Hammond et al. | 182/177 |
| 55,817 | A | * | 6/1866 | Capron | 182/104 |
| 226,943 | A | * | 4/1880 | Valley | 182/175 |
| 575,574 | A | * | 1/1897 | Pugh | 182/27 |
| 918,553 | A | * | 4/1909 | Hoppe | 182/22 |
| 1,010,832 | A | * | 12/1911 | Welden | 182/25 |
| 2,449,609 | A | | 9/1948 | Linder et al. | |
| 2,481,581 | A | * | 9/1949 | Ehnhuus | 182/174 |
| 3,173,512 | A | | 3/1965 | Sturdy et al. | |
| 3,233,702 | A | | 2/1966 | Feltrop | |
| 3,724,592 | A | * | 4/1973 | Fleicher | 182/203 |
| 4,241,807 | A | | 12/1980 | McKenna et al. | |
| 4,423,797 | A | * | 1/1984 | Batten | 182/204 |
| 4,482,030 | A | | 11/1984 | Lincourt | |
| 4,524,847 | A | * | 6/1985 | Mintz | 182/23 |
| 4,718,518 | A | * | 1/1988 | Brown | 182/22 |
| 4,899,970 | A | | 2/1990 | Berzina | |
| 4,964,601 | A | | 10/1990 | Dishman | |
| 4,979,710 | A | | 12/1990 | Baldwin | |
| 4,989,692 | A | * | 2/1991 | Min | 182/166 |
| 5,275,256 | A | | 1/1994 | Ellzey | |
| D343,906 | S | | 2/1994 | Murray | |
| 5,332,062 | A | * | 7/1994 | Revere | 182/27 |
| 5,429,205 | A | | 7/1995 | Collins | |
| 5,577,574 | A | * | 11/1996 | Joseph | 182/174 |
| 5,853,065 | A | * | 12/1998 | Hutson et al. | 182/204 |
| 6,729,440 | B1 | * | 5/2004 | Bailey | 182/204 |

* cited by examiner

*Primary Examiner*—Hugh B. Thompson, II
(74) *Attorney, Agent, or Firm*—Donald R. Schoonover

(57) ABSTRACT

A ladder is adjustable in a plurality of planes so a wide variety of sloped surfaces can be accommodated. The ladder includes non-slip surfaces on the steps and a paint can holder that can accommodate a one gallon paint can.

1 Claim, 2 Drawing Sheets

ADJUSTABLE LADDER

BACKGROUND OF THE INVENTION

1. Field of the Invention

The present invention relates to the general art of ladders, and to the particular field of ladders with supporting surface compensating means.

2. Discussion of the Related Art

Many jobs require the use of a ladder. One of the most common jobs requiring the use of a ladder is painting. Accordingly, the art contains a multitude of ladders.

A problem that is common to many ladder uses is that associated with uneven supporting surfaces. That is, sometimes a ladder must be supported on sloping terrain adjacent to a work site, such as a house, or the like. Another situation occurs when a ladder must be supported on stair steps. While the art contains examples of ladders that can be adjusted to accommodate one type of uneven supporting surface, the inventor is not aware of any ladders that can accommodate a wide variety of different uneven supporting surfaces.

Therefore, there is a need for a ladder that can be adjusted for a plurality of different sloped surfaces.

Of course, if a ladder is used, the user requires that the ladder be stable and secure. Falls from ladders can be dangerous, if not fatal. The need for secure support is especially critical if the ladder is to be supported on an uneven supporting surface since the ladder may not be level when in the use configuration.

Therefore, there is a need for a ladder that can be adjusted for a plurality of different sloped surfaces and which is sturdy and stable in all configurations.

Of course, cost is a major factor in any product that will be sold to consumers. Therefore, a ladder that can safely accommodate a wide variety of different sloped supporting surfaces is useful, such a ladder should also be cost effective to manufacture and sell if it is to be commercially viable.

Therefore, there is a need for a ladder that can be adjusted for a plurality of different sloped surfaces and which is sturdy and stable in all configurations and is cost effective to manufacture and purchase.

Many ladders have work supporting platforms located near the top of the ladder. A worker can support tools as well as other objects on this platform. If a ladder is used by a painter, the painter often desires to support a paint can on the platform. The inventor is aware of such ladders, but is not aware of platforms that can accommodate a full one gallon can of paint in a secure manner. Some platforms can accommodate small cans of paint, but the inventor is not aware of any platform that can securely accommodate a one gallon can.

Therefore, there is a need for a ladder that can be adjusted for a plurality of different sloped surfaces and can securely hold work elements.

PRINCIPAL OBJECTS OF THE INVENTION

It is a main object of the present invention to provide a ladder that can be adjusted for a plurality of different sloped surfaces.

It is another object of the present invention to provide a ladder that can be adjusted for a plurality of different sloped surfaces and which is sturdy and stable in all configurations.

It is another object of the present invention to provide a ladder that can be adjusted for a plurality of different sloped surfaces and which is sturdy and stable in all configurations and is cost effective to manufacture and purchase.

It is another object of the present invention to provide a ladder that can be adjusted for a plurality of different sloped surfaces and can securely hold work elements.

SUMMARY OF THE INVENTION

These, and other, objects are achieved by an adjustable ladder that includes legs that are swivably attached to a top element and which have height-adjusting elements thereon. Non-slip surfaces are located on the ladder steps and a work holder has a cutout that is sized to accommodate a one gallon paint can. Locking bars hold the legs in selected relative positions so the ladder can accommodate sloped surfaces as well as steps.

Using the adjustable features of the ladder embodying the present invention will permit a ladder to be adjusted in a plurality of ways so a wide variety of supporting surfaces can be accommodated while the ladder remains stable in all conditions. The ladder is safe to use and can accommodate work elements, including one gallon paint containers, in a stable and secure manner. The ladder can be manufactured in a manner that is cost effective, so the cost to a consumer can be effective as well.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in an adjustable ladder 10 which can accommodate a wide range of different ladder supporting surfaces. The ladder can be formed of aluminum or other suitable materials.

Figure 2:
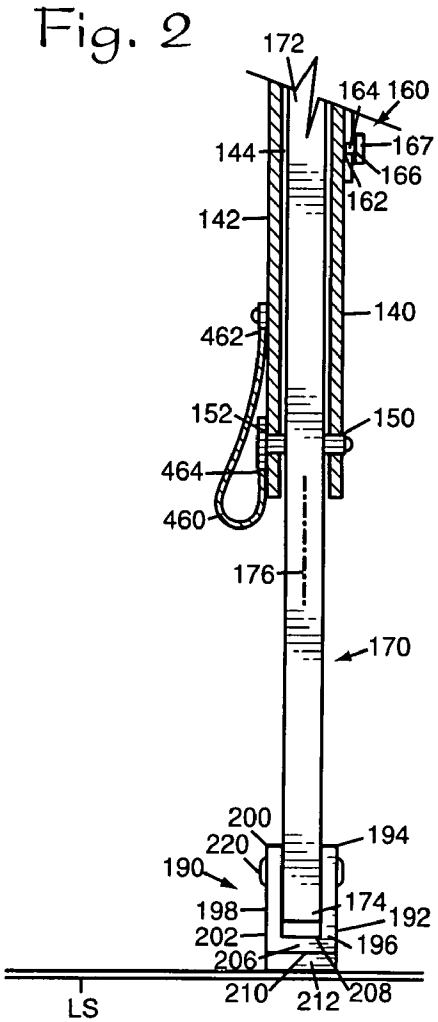
FIG. 2 is an elevational view taken along line 2—2 of FIG. 1.
Figure 1:
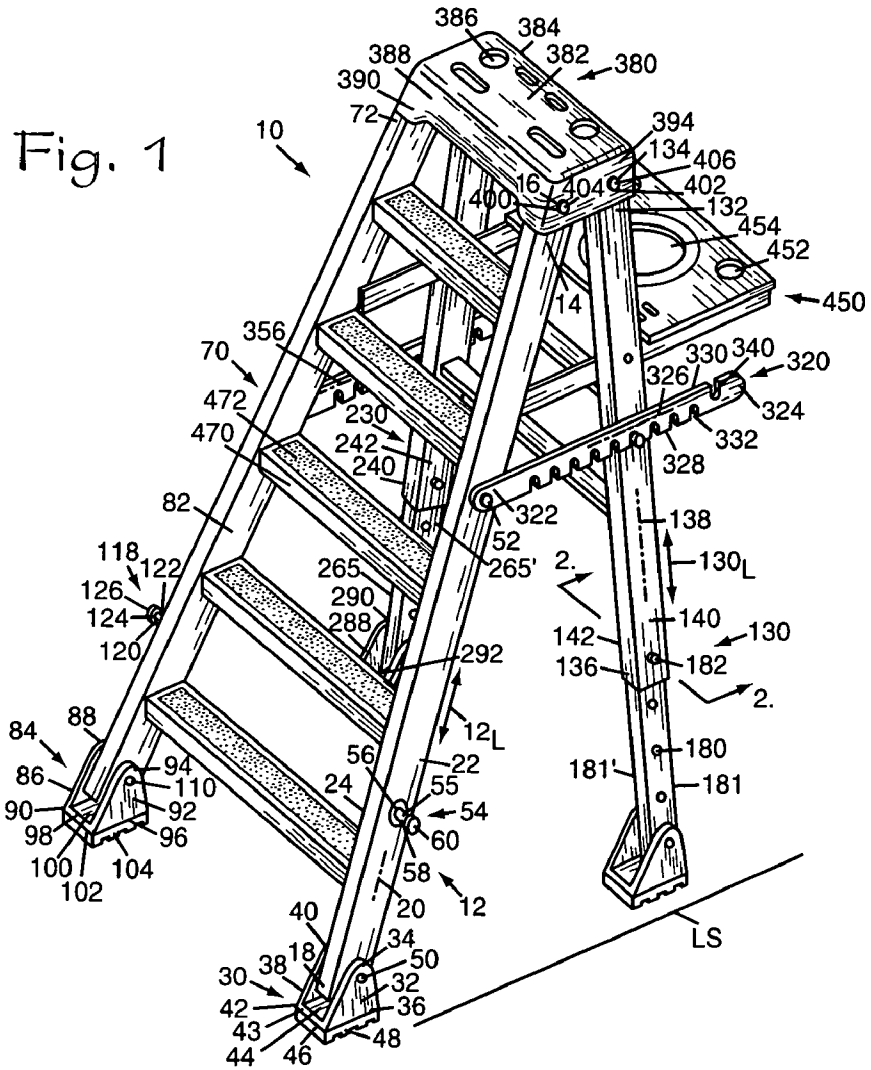
FIG. 1 is a perspective view of an adjustable ladder embodying the present invention.

Ladder 10 comprises a first leg 12 which is a first front leg in a use condition such as shown in FIG. 1. First leg 12 includes a first end 14 that is a top end when the first leg 12 is in the use condition. The first end 14 has a pivot pin-accommodating hole 16 defined therethrough. First leg 12 further includes a second end 18 that is a bottom end when the first leg 12 is in the use condition and a longitudinal axis 20 which extends between the first end 14 of the first leg 12 and the second end 18 of the first leg 12. First leg 12 further includes a first side surface 22 and a second side surface 24.

First leg 12 has a longitudinal length $\mathbf{12}_L$ which is measured between the first end 14 of the first leg 12 and the second end 18 of the first leg 12.

First leg 12 further includes a first support surface-engaging shoe 30 which is pivotally attached to the first leg 12 adjacent to the second end 18 of the first leg 12. First support surface-engaging shoe 30 includes a first mounting plate 32, that is triangular in shape and which includes an apex 34 and a base 36, and a second mounting plate 38, that is triangular in shape and which includes an apex 40 and a base 42.

First support surface-engaging shoe 30 further includes a bottom element 43 that connects the base 36 of the first mounting plate 32 of the first support surface-engaging shoe 30 to the base 42 of the second mounting plate 38 of the first support surface-engaging shoe 30. Bottom element 43 of the first support surface-engaging shoe 30 includes a first surface 44 that is a top surface in the use condition, a second surface 46 that is a bottom surface in the use condition, and a non-slip element 48 on the second surface 46 of the first support surface-engaging shoe 30 and which is adapted to engage a ladder-supporting surface LS in the use condition.

The first mounting plate 32 of the first support surface-engaging shoe 30 is located adjacent to the first side surface 22 of the first leg 12 and the second mounting plate 38 of the first support surface-engaging shoe 30 is located adjacent to the second side surface 24 of the first leg 12.

A pivot pin 50 extends through the first leg 12 and is connected to the first mounting plate 32 of the first support surface-engaging shoe 30 adjacent to the apex 34 of the first mounting plate 32 of the first support surface-engaging shoe 30 and to the second mounting plate 38 of the first support surface-engaging shoe 30 adjacent to the apex 40 of the second mounting plate 38 of the first support surface-engaging shoe 30. The pivot pin 50 of the first support surface-engaging shoe 30 pivotally connects the first support surface-engaging shoe 30 to the first leg 12 adjacent to the second end 18 of the first leg 12.

A pivot fastener 52 extends through the first leg 12 at a location spaced apart from the pivot pin 50 of the first support surface-engaging shoe 30.

A brace storage pin 54 is fixedly mounted on the first leg 12 and extends outwardly from the first side surface 22 of the first leg 12. The brace storage pin 54 includes a body 55 which has a proximal end 56 fixedly mounted on the first leg 12, a distal end 58 which is spaced apart from the first side surface 22 of the first leg 12, and a head 60 on the distal end 58 of the brace storage pin 54. The brace storage pin 54 is spaced apart from the pivot pin 50 and from the pivot fastener 52.

Ladder 10 further includes a second leg 70 which is a second front leg in the use condition. Second leg 70 includes a first end 72 that is a top end when the second leg 70 is in the use condition. The first end 72 of the second leg 70 has a pivot pin-accommodating hole 74 (see FIG. 3) defined therethrough.

Second leg 70 further includes a second end 76 that is a bottom end when the second leg 70 is in the use condition, and a longitudinal axis 78 which extends between the first end 72 of the second leg 70 and the second end 76 of the second leg 70.

Second leg 70 further includes a first side surface 80 and a second side surface 82.

Second leg 70 has a longitudinal length $70_L$ which is measured between the first end 72 of the second leg 70 and the second end 76 of the second leg 70. The longitudinal length of the second leg 70 is equal to the longitudinal length of the first leg 12.

Second leg 70 further includes a second support surface-engaging shoe 84 which is pivotally attached to the second leg 70 adjacent to the second end 76 of the second leg 70. Second support surface-engaging shoe 84 includes a first mounting plate 86 that is triangular in shape and which includes an apex 88 and a base 90. Second support surface-engaging shoe 84 further includes a second mounting plate 92 that is triangular in shape and includes an apex 94 and a base 96.

Second support surface-engaging shoe 84 further includes bottom element 98 that connects the base 90 of the first mounting plate 86 of the second support surface-engaging shoe 84 to the base 96 of the second mounting plate 92 of the second support surface-engaging shoe 84. Bottom element 98 includes a first surface 100 that is a top surface in the use condition, a second surface 102 that is a bottom surface in the use condition, and a non-slip element 104 on the second surface 102 of the second support surface-engaging shoe 84 and which is adapted to engage a ladder-supporting surface in the use condition.

The first mounting plate 86 of the second support surface-engaging shoe 84 is located adjacent to the first side surface 80 of the second leg 70 and the second mounting plate 92 of the second support surface-engaging shoe 84 is located adjacent to the second side surface 82 of the second leg 70.

A pivot pin 110 extends through the second leg 70 and is connected to the first mounting plate 86 of the second support surface-engaging shoe 84 adjacent to the apex 88 of the first mounting plate 86 of the second support surface-engaging shoe 84 and to the second mounting plate 92 of the second support surface-engaging shoe 84 adjacent to the apex 94 of the second mounting plate 92 of the second support surface-engaging shoe 84. Pivot pin 110 of the second support surface-engaging shoe 84 pivotally connects the second support surface-engaging shoe 84 to the second leg 70 adjacent to the second end 76 of the second leg 70.

A pivot fastener 114 extends through the second leg 70 at a location spaced apart from the pivot pin 110 of the second support surface-engaging shoe 84.

A brace storage pin 118 is fixedly mounted on the second leg 70 and extends outwardly from the first side surface 80 of the second leg 70. Brace storage pin 118 is identical to brace storage pin 54 and includes a body 120 having a proximal end 122 fixedly mounted on the second leg 70, a distal end 124 spaced apart from the first side surface 80 of the second leg 70, and a head 126 on the distal end 124 of the brace storage pin 118 on the second leg 70. The brace storage pin 118 of the second leg 70 is spaced apart from the pivot pin 110 of the second leg 70 and from the pivot fastener 114 of the second leg 70.

Ladder 10 further includes a third leg 130 which is a first rear leg in the use condition and which includes a first end 132 that is a top end when the third leg 130 is in the use condition. The first end 132 of the third leg 130 has a pivot pin-accommodating hole 134 defined therethrough.

Third leg 130 further includes a second end 136, that is a bottom end when the third leg 130 is in the use condition, and a longitudinal axis 138 that extends between the first end 132 of the third leg 130 and the second end 136 of the third leg 130.

Third leg 130 further includes a first side surface 140 and a second side surface 142.

The third leg 130 is hollow and has a bore 144 defined therein. The bore 144 of the third leg 130 extends from the second end 136 of the third leg 130 toward the first end 132 of the third leg 130 in the direction of the longitudinal axis 138 of the third leg 130.

The third leg also has a longitudinal length 130L which is measured between the first end 132 of the third leg 130 and the second end 136 of the third leg 130. The longitudinal length of the third leg 130 is less than the longitudinal length of the first leg 12.

A first lock pin-accommodating hole 150 is defined through the first side surface 140 of the third leg 130 adjacent to the second end 136 of the third leg 130.

A second lock pin-accommodating hole 152 is defined through the second side surface 142 of the third leg 130 adjacent to the second end 136 of the third leg 130. The second lock pin-accommodating hole 152 of the third leg 130 is aligned with the first lock pin-accommodating hole 150 of the third leg 130.

Third leg 130 further includes a brace arm-supporting element 160 fixedly mounted on the first side surface 140 of the third leg 130. Brace arm-supporting element 160 includes a proximal end 162 fixedly mounted on the first side surface 140 of the third leg 130, a body 164, a distal end 166 spaced apart from the first side surface 140 of the third leg 130, and a head 167 on the distal end 166 of the brace arm-supporting element 160 of the third leg 130.

A third leg extension element 170 is telescopingly accommodated in the bore 144 defined in the third leg 130. The third leg extension element 170 includes a first end 172 which is a top end when the third leg 130 is in the use condition. The first end 172 of the third leg extension element 170 is located inside the bore 144 defined in the third leg 130. Third leg extension element 170 further includes a second end 174 which is a bottom end when the third leg 130 is in the use condition. The second end 174 of the third leg extension element 170 is located outside the bore 144 defined in the third leg 130.

The third leg extension element 170 has a longitudinal axis 176 which extends between the first end 172 of the third leg extension element 170 and the second end 174 of the third leg extension element 170.

The third leg extension element 170 further includes a plurality of lock pin-accommodating holes, such as hole 180, defined through the third leg extension element 170 from a first side surface 181 to a second side surface 181' at locations on the third leg extension element 170 that are spaced apart from each other in the direction of the longitudinal axis 176 of the third leg extension element 170. Each of the lock pin-accommodating holes 180 defined in the third leg extension element 170 is adapted to be aligned with the first and second lock pin-accommodating holes 150, 152 defined through the first and second side surfaces 140, 142 of the third leg 130.

A third leg extension element lock pin 182 is adapted to extend through the first and second lock pin-accommodating holes 150, 152 defined through the first and second side surfaces 140, 142 of the third leg 130 and through a selected one of the plurality of lock pin-accommodating holes 180 defined through the third leg extension element 170 to lock the third leg extension element 170 to the third leg 130. A third support surface-engaging shoe 190 is pivotally attached to the third leg extension element 170 adjacent to the second end 174 of the third leg extension element 170. The third support surface-engaging shoe 190 of the third leg extension element 170 includes a first mounting plate 192 that is triangular in shape and which includes an apex 194 and a base 196. Third support surface-engaging shoe 190 further includes a second mounting plate 198 that is triangular in shape and which includes an apex 200 and a base 202.

The third support surface-engaging shoe 190 further includes a bottom element 206 that connects the base 196 of the first mounting plate 192 of the third support surface-engaging shoe 190 to the base 202 of the second mounting plate 198 of the third support surface-engaging shoe 190. The bottom element 206 of the third support surface-engaging shoe 190 includes a first surface 208 that is a top surface in the use condition, a second surface 210 that is a bottom surface in the use condition, and a non-slip element 212 on the second surface 210 of the third support surface-engaging shoe 190 and which is adapted to engage a ladder-supporting surface in the use condition.

The first mounting plate 192 of the bottom element 206 of the third support surface-engaging shoe 190 is located adjacent to the first side surface 181 of the third leg extension element 170 and the second mounting plate 198 of the bottom element 206 of the third support surface-engaging shoe 190 being located adjacent to the second side surface 181' of the third leg extension element 170.

A pivot pin 220 extends through the third leg extension element 170 and is connected to the first mounting plate 192 of the third support surface-engaging shoe 190 adjacent to the apex 194 of the first mounting plate 192 of the third support surface-engaging shoe 190 and to the second mounting plate 198 of the third support surface-engaging shoe 190 adjacent to the apex 200 of the second mounting plate 198 of the third support surface-engaging shoe 190. The pivot pin 220 on the third leg 130 pivotally connects the third support surface-engaging shoe 190 to the third leg extension element 170 adjacent to the second end 174 of the third leg extension element 170.

Ladder 10 further includes a fourth leg 230 which is identical to the just-described third leg 130 and is a second rear leg in the use condition. Fourth leg 230 includes a first end 232 that is a top end when the fourth leg 230 is in the use condition. The first end 232 of the fourth leg 230 has a pivot pin-accommodating hole 234 defined therethrough. Fourth leg 230 further includes a second end 236 that is a bottom end when the fourth leg 230 is in the use condition. A longitudinal axis 238 extends between the first end 232 of the fourth leg 230 and the second end 236 of the fourth leg 230. The fourth leg 230 further includes a first side surface 240 and a second side surface 242.

The fourth leg 230 is hollow and has a bore 244 defined therein. The bore 244 of the fourth leg 230 extends from the second end 236 of the fourth leg 230 toward the first end 232 of the fourth leg 230 in the direction of the longitudinal axis 218 of the fourth leg 230.

Fourth leg 230 further includes a longitudinal length 240L that is measured between the first end 232 of the fourth leg 230 and the second end 236 of the fourth leg 230. The longitudinal length of the fourth leg 230 is less than the longitudinal length of the second leg 70 and is equal to the longitudinal length of the third leg 130.

A first lock pin-accommodating hole 245 is defined through the first side surface 240 of the fourth leg 230 adjacent to the second end 236 of the fourth leg 230, and a second lock pin-accommodating hole 246 is defined through the second side surface 242 of the fourth leg 230 adjacent to the second end 236 of the fourth leg 230. The second lock pin-accommodating hole 246 of the fourth leg 230 is aligned with the first lock pin-accommodating hole 245 of the fourth leg 230.

A brace arm-supporting element 250 is fixedly mounted on the first side surface 240 of the fourth leg 230. The brace arm-supporting element 250 of the fourth leg 230 includes a proximal end 252 fixedly mounted on the first side surface 240 of the fourth leg 230, a body 254, a distal end 256 spaced apart from the first side surface 240 of the fourth leg 250, and a head 258 on the distal end 256 of the brace arm-supporting element 250 of fourth leg 230.

A fourth leg extension element 260 is telescopingly accommodated in the bore 244 defined in the fourth leg 230.

The fourth leg extension element 260 is identical to the above-described third leg extension element 170 and includes a first end 262 which is a top end when the fourth leg 230 is in the use condition. The first end 262 of the fourth leg extension element 260 is located inside the bore 244 defined in the fourth leg 230. The fourth leg extension element 260 further includes a second end 264 which is a bottom end when the fourth leg 230 is in the use condition. The second end 264 of the fourth leg extension element 260 is located outside the bore 244 defined in the fourth leg 230. The fourth leg extension element 260 further includes a first side surface 265 and a second side surface 265'.

A longitudinal axis 266 extends between the first end 262 of the fourth leg extension element 260 and the second end 264 of the fourth leg extension element 260.

A plurality of lock pin-accommodating holes, such as hole 270, are defined through the fourth leg extension element 260 at locations on the fourth leg extension element 260 that are spaced apart from each other in the direction of the longitudinal axis 266 of the fourth leg extension element 260. Each of the lock pin-accommodating holes 270 defined in the fourth leg extension element 260 is adapted to be aligned with the first and second lock pin-accommodating holes 245, 246 defined through the first and second side surfaces 240, 242 of the fourth leg 230.

A fourth leg extension element lock pin 272 is adapted to extend through the first and second lock pin-accommodating holes 245, 246 defined through the first and second side surfaces 240, 242 of the fourth leg 230 and through a selected one of the plurality of lock pin-accommodating holes 270 defined through the fourth leg extension element 260 to lock the fourth leg extension element 260 to the fourth leg 230.

A fourth support surface-engaging shoe 280 is identical to the above-described first, second and third support surface-engaging shoes 30, 84, 190, and is pivotally attached to the fourth leg extension element 260 adjacent to the second end 264 of the fourth leg extension element 260. The fourth support surface-engaging shoe 280 of the fourth leg extension element 260 includes a first mounting plate 282 that is triangular in shape and which includes an apex 284 and a base 286. A second mounting plate 288 is triangular in shape and includes an apex 290 and a base 292. A bottom element 300 connects the base 286 of the first mounting plate 282 of the fourth support surface-engaging shoe 280 to the base 292 of the second mounting plate 288 of the fourth support surface-engaging shoe 280. The bottom element 300 of the fourth support surface-engaging shoe 280 includes a first surface 302 that is a top surface in the use condition, a second surface 304 that is a bottom surface in the use condition, and a non-slip element 306 on the second surface 304 of the fourth support surface-engaging shoe 280 and which is adapted to engage a ladder-supporting surface in the use condition.

The first mounting plate 282 of the bottom element 300 of the fourth support surface-engaging shoe 280 being located adjacent to the first side surface 265 of the fourth leg extension element 260 and the second mounting plate 288 of the bottom element 300 of the fourth support surface-engaging shoe 280 being located adjacent to the second side surface 265' of the fourth leg extension element 260.

A pivot pin 310 extends through the fourth leg extension element 260 and is connected to the first mounting plate 282 of the fourth support surface-engaging shoe 280 adjacent to the apex 284 of the first mounting plate 282 of the fourth support surface-engaging shoe 280 and to the second mounting plate 288 of the fourth support surface-engaging shoe 280 adjacent to the apex 290 of the second mounting plate 288 of the fourth support surface-engaging shoe 280. The pivot pin 310 on the fourth leg 230 pivotally connects the fourth support surface-engaging shoe 280 to the fourth leg extension element 260 adjacent to the second end 264 of the fourth leg extension element 260.

A first brace element 320 includes a proximal end 322 pivotally attached to the first leg 12 by the pivot fastener 52 on the first leg 12, a distal end 324, and a longitudinal axis 326 which extends between the proximal end 322 of the first brace element 320 and the distal end 324 of the first brace element 320.

First brace element 320 further includes a first side edge 328, a second side edge 330, and a plurality of notches, such as notch 332, defined in the first brace element 320 adjacent to the first side edge 328. The notches 332 of the plurality of notches are spaced apart from each other in the direction of the longitudinal axis 336 of the first brace element 320.

The first brace element 320 further includes a lock notch 340 defined in the first brace element 320 adjacent to the distal end 324 of the first brace element 320 and adjacent to the second side edge 330 of the first brace element 320.

The first brace element 320 is pivotal between a use position shown in FIG. 1 extending between the first and third legs 12, 130 and a stored position in which the longitudinal axis 326 of the first brace element 320 extends in the direction of the longitudinal axis 20 of the first leg 12.

The lock notch 340 of the first brace element 320 is located and sized to engage the brace storage pin 54 on the first leg 12 when the first brace element 320 is in the stored position.

Each notch 332 of the plurality of notches of the first brace element 320 is sized to engage the brace-supporting element 160 on the third leg 130.

A second brace element 350 is identical to the just-described first brace element 320 and includes a proximal end 352 pivotally attached to the second leg 70 by the pivot fastener 114 on the second leg 70, a distal end 354, and a longitudinal axis 356 which extends between the proximal end 352 of the second brace element 350 and the distal end 354 of the second brace element 350.

Second brace element 350 further includes a first side edge 360, a second side edge 362, a plurality of notches, such as notch 364, defined in the second brace element 350 adjacent to the first side edge 360 of the second brace element 350. The notches 364 of the plurality of notches of the second brace element 350 are spaced apart from each other in the direction of the longitudinal axis 356 of the second brace element 350.

Second brace element 350 further includes a lock notch 370 defined in the second brace element 350 adjacent to the distal end 354 of the second brace element 350 and adjacent to the second side edge 362 of the second brace element 350. The second brace element 350 is pivotal between a use position extending between the second and fourth legs 70, 230 and a stored position in which the longitudinal axis 356 of the second brace element 350 extends in the direction of the longitudinal axis 78 of the second leg 70.

The lock notch 370 of the second brace element 350 is located and sized to engage the brace storage pin 118 on the second leg 70 when the second brace element 350 is in the stored position. Each notch 364 of the plurality of notches of the second brace element 350 is sized to engage the brace-supporting element 250 on the fourth leg 230.

Ladder 10 further comprises a top unit 380 which includes a planar body 382 which has a peripheral edge 384. A plurality of tool-accommodating holes, such as hole 386, are defined through the planar body 382. A skirt 388 is located on the peripheral edge 384 of the planar body 382. The skirt 388 includes a front section 390, a rear section 392, a first end section 394, and a second end section 396.

A first pivot pin-accommodating hole 400 is defined through the first end section 394 of the skirt 388 adjacent to the front section 390 of the skirt 388, a second pivot pin-accommodating hole 402 is defined through the first end section 394 of the skirt 388 adjacent to the rear section 392 of the skirt 388, and a first pivot pin 404 extends through the first pivot pin-accommodating hole 400 of the skirt 388 of the top unit 380 and through the pivot pin-accommodating hole 16 defined in the first leg 12 adjacent to the first end 14 of the first leg 12. The first leg 12 is thus pivotally attached to the top unit 380 by the first pivot pin 404.

A second pivot pin 406 extends through the second pivot pin-accommodating hole 402 in the skirt 388 of the top unit 380 and through the pivot pin-accommodating hole 74 defined in the second leg 70 adjacent to the first end 72 of the second leg 70. The second leg 70 is thus pivotally attached to the top unit 380 by the second pivot pin 406.

A third pivot pin-accommodating hole is defined through the second end section 396 of the skirt 388 adjacent to the front section 390 and a fourth pivot pin-accommodating hole is defined through the second end section 396 of the skirt 388 adjacent to the rear section 392 of the skirt 388. A third pivot pin extends through the third pivot pin-accommodating hole of the skirt 388 of the top unit 380 and through the pivot pin-accommodating hole 134 defined in the third leg 130 adjacent to the first end 132 of the third leg 130. The third and fourth pivot pin-accommodating holes are identical to the just-described first and second pivot pin-accommodating holes 400, 402 and thus are not shown for the sake of clarity of the Figures. The third leg is pivotally attached to the top unit 380 by the third pivot pin.

A fourth pivot pin is identical to the first and second pivot pins 404, 406 and is not shown for the sake of clarity of the Figures and extends through the fourth pivot pin-accommodating hole of the skirt 388 of the top unit 380 and through the pivot pin-accommodating hole 234 defined in the fourth leg 230 adjacent to the first end 232 of the fourth leg 230. The fourth leg 230 is thus pivotally attached to the top unit 380 by the fourth pivot pin.

A work support unit 450 is pivotally attached to the third leg 130 and to the fourth leg 230. The work support unit 450 includes a plurality of tool-accommodating holes, such as hole 452, defined therethrough and a support area 454 that is sized to securely support and encircle a one gallon paint can.

A first tether 460 has a proximal end 462 fixedly secured to the third leg 130 and a distal end 464 fixedly secured to the third leg extension element lock pin 182.

A second tether is identical to the just-described first tether and is not shown for the sake of clarity of the Figures. The fourth tether has a proximal end fixedly secured to the fourth leg 230 and a distal end fixedly secured to the fourth leg extension element lock pin 272.

Ladder 10 further includes a plurality of ladder steps, such as ladder step 470. Each ladder step has a non-slip element, such as element 472, fixedly mounted thereon.

Figure 5:
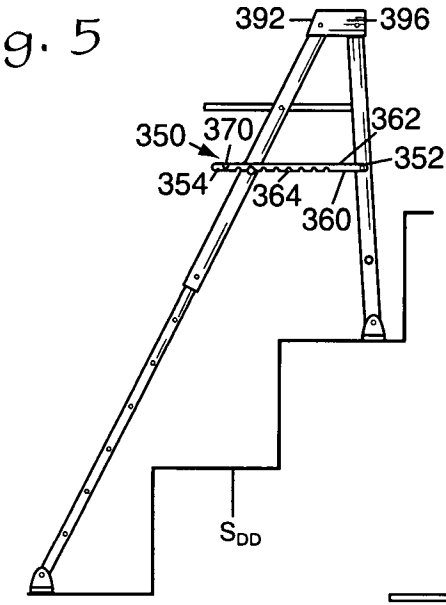
FIG. 5 shows a ladder embodying the present invention on a stepped surface.
Figure 6:
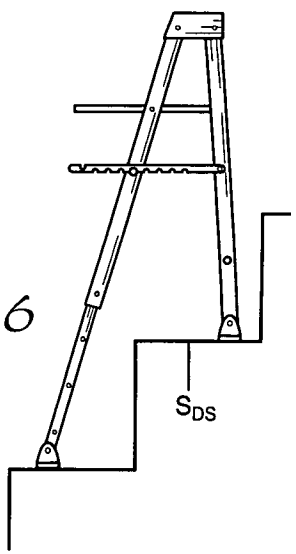
FIG. 6 shows a ladder embodying the present invention on a stepped surface.
Figure 3:
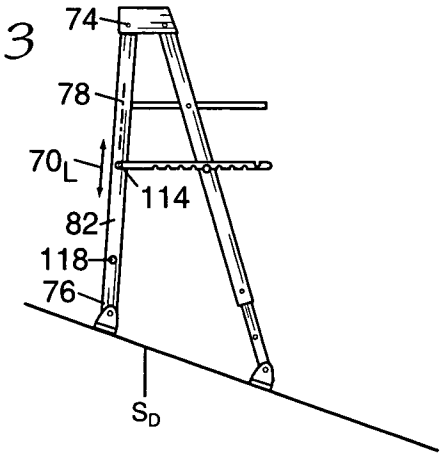
FIG. 3 shows a ladder embodying the present invention on an inclined surface.
Figure 4:
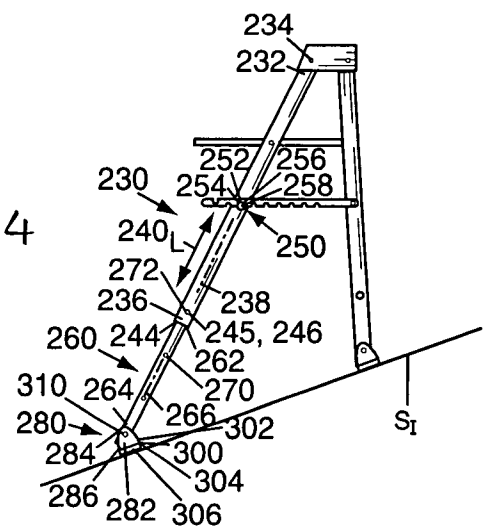
FIG. 4 shows a ladder embodying the present invention on an inclined surface.

As can be understood from the Figures, especially FIGS. 3–6, ladder 10 can accommodate a wide range of differently sloped ladder-supporting surfaces, including, but not limited to, a declining ladder-supporting surface $S_d$ shown in FIG. 3, an inclining ladder-supporting surface $S_I$ shown in FIG. 4, a double stepped-supporting surface $S_{DD}$ shown in FIG. 5, or a single step-supporting surface $S_{DS}$ shown in FIG. 6. Other variations will occur to those skilled in the art based on the teaching of this disclosure, and such additional variations are intended to be covered by this disclosure as well. The size of the inclines can be accommodated by not only the telescoping portions of the ladder legs, but by the relative angular positions of the first and third and the second and fourth ladder legs as well.

It is understood that while certain forms of the present invention have been illustrated and described herein, it is not to be limited to the specific forms or arrangements of parts described and shown.

What is desired to be secured by Letters Patent is:

1. An adjustable ladder comprising:

a) a first leg which is a first front leg in a use condition and which includes (1) a first end that is a top end when said first leg is in the use condition, the first end having a pivot pin-accommodating hole defined therethrough, (2) a second end that is a bottom end when said first leg is in the use condition, (3) a longitudinal axis which extends between the first end of said first leg and the second end of said first leg, (4) a first side surface, (5) a second side surface, (6) said first leg having a longitudinal length which is measured between the first end of said first leg and the second end of said first leg, (7) a first support surface engaging shoe pivotally attached to said first leg adjacent to the second end of said first leg, the first support surface-engaging shoe on said first leg including (A) a first mounting plate that is triangular in shape and which includes an apex and a base, (B) a second mounting plate that is triangular in shape and which includes an apex and a base, (C) a bottom element that connects the base of the first mounting plate of the first support surface-engaging shoe to the base of the second mounting plate of the first support surface-engaging shoe, the bottom element of the first support surface-engaging shoe including a first surface that is a top surface in the use condition, a second surface that is a bottom surface in the use condition, and a non-slip element on the second surface of the first support surface-engaging shoe and which is adapted to engage a ladder-supporting surface in the use condition, (D) the first mounting plate of the first support surface-engaging shoe being located adjacent to the first side surface of said first leg and the second mounting plate of the first support surface-engaging shoe being located adjacent to the second side surface of said first leg, and (E) a pivot pin which extends through said first leg and is connected to the first mounting plate of the first support surface-engaging shoe adjacent to the apex of the first mounting plate of the first support surface-engaging shoe and to the second mounting plate of the first support surface-engaging shoe adjacent to the apex of the second mounting plate of the first support surface-engaging shoe, the pivot pin of the first support surface-engaging shoe pivotally connecting the first support surface-engaging shoe to said first leg adjacent to the second end of said first leg, (8) a pivot fastener which extends through said first leg at a location spaced apart from the pivot pin of the first support surface-engaging shoe, and (9) a brace storage pin fixedly mounted on said first leg and which extends outwardly from the first side surface of said first leg, the brace storage pin including a body having a proximal end fixedly mounted on said first leg, a distal end spaced apart from the first side surface of said first leg, and a head on the distal end of the brace storage pin, the brace storage pin being spaced apart from the pivot pin and from the pivot fastener;

b) a second leg which is a second front leg in the use condition and which includes (1) a first end that is a top end when said second leg is in the use condition, the first end of said second leg having a pivot pin-accommodating hole defined therethrough, (2) a second end that is a bottom end when said second leg is in the use condition, (3) a longitudinal axis which extends between the first end of said second leg and the second end of said second leg, (4) a first side surface, (5) a second side surface, (6) said second leg having a longitudinal length which is measured between the first end of said second leg and the second end of said second leg, the longitudinal length of said second leg being equal to the longitudinal length of said first leg, (7) a second support surface-engaging shoe pivotally attached to said second leg adjacent to the second end of said second leg, the second support surface-engaging shoe on said second leg including (A) a first mounting plate that is triangular in shape and which includes an apex and a base, (B) a second mounting plate that is triangular in shape and which includes an apex and a base, (C) a bottom element that connects the base of the first mounting plate of the second support surface-engaging shoe to the base of the second mounting plate of the second support surface-engaging shoe, the bottom element of the second support surface-engaging shoe including a first surface that is a top surface in the use condition, a second surface that is a bottom surface in the use condition, and a non-slip element on the second surface of the second support surface-engaging shoe and which is adapted to engage a ladder supporting surface in the use condition, (D) the first mounting plate of the second support surface-engaging shoe being located adjacent to the first side surface of said second leg and the second mounting plate of the second support surface-engaging shoe being located adjacent to the second side surface of said second leg, and (E) a pivot pin which extends through said second leg and is connected to the first mounting plate of the second support surface-engaging shoe adjacent to the apex of the first mounting plate of the second support surface-engaging shoe and to the second mounting plate of the second support surface-engaging shoe adjacent to the apex of the second mounting plate of the second support surface-engaging shoe, the pivot pin of the second support surface-engaging shoe pivotally connecting the second support surface-engaging shoe to said second leg adjacent to the second end of said second leg, (8) a pivot fastener which extends through said second leg at a location spaced apart from the pivot pin of the second support surface engaging shoe, and (9) a brace storage pin fixedly mounted on said second leg and which extends outwardly from the first side surface of said second leg, the brace storage pin of said second leg including a body having a proximal end fixedly mounted on said second leg, a distal end spaced apart from the first side surface of said second leg, and a head on the distal end of the brace storage pin on said second leg, the brace storage pin of said second leg being spaced apart from the pivot pin of said second leg and from the pivot fastener of said second leg;

c) a third leg which is a first rear leg in the use condition and which includes (1) a first end that is a top end when said third leg is in the use condition, the first end of said third leg having a pivot pin-accommodating hole defined therethrough, (2) a second end that is a bottom end when said third leg is in the use condition, (3) a longitudinal axis that extends between the first end of the third leg and the second end of the third leg, (4) a first side surface, (5) a second side surface, (6) the third leg being hollow and having a bore defined therein, the bore of the third leg extending from the second end of the third leg toward the first end of the third leg in the direction of the longitudinal axis of the third leg, (7) a longitudinal length of the third leg which is measured between the first end of the third leg and the second end of the third leg, the longitudinal length of said third leg being less than the longitudinal length of said first leg, (8) a first lock pin-accommodating hole defined through the first side surface of said third leg adjacent to the second end of said third leg, (9) a second lock pin-accommodating hole defined through the second side surface of said third leg adjacent to the second end of said third leg, the second lock pin-accommodating hole of said third leg being aligned with the first lock pin-accommodating hole of said third leg,

(10) a brace arm-supporting element fixedly mounted on the first side surface of said third leg, the brace arm-supporting element including a proximal end fixedly mounted on the first side surface of said third leg, a body, a distal end spaced apart from the first side surface of said third leg, and a head on the distal end of the brace arm-supporting element of said third leg,

(11) a third leg extension element telescopingly accommodated in the bore defined in said third leg, the third leg extension element including (A) a first end which is a top end when said third leg is in the use condition, the first end of the third leg extension element being located inside the bore defined in said third leg, (B) a second end which is a bottom end when said third leg is in the use condition, the second end of the third leg extension element being located outside the bore defined in said third leg, (C) a longitudinal axis which extends between the first end of the third leg extension element and the second end of the third leg extension element, (D) a first side surface, (E) a second side surface, (F) a plurality of lock pin-accommodating holes defined through the third leg extension element at locations on the third leg extension element that are spaced apart from each other in the direction of the longitudinal axis of the third leg extension element, each of the lock pin-accommodating holes defined in the third leg extension element being adapted to be aligned with the first and second lock pin-accommodating holes defined through the first and second side surfaces of said third leg, and (G) a third leg extension element lock pin which is adapted to extend through the first and second lock pin-accommodating holes defined through the first and second side surfaces of said third leg and through a selected one of the plurality of lock pin-accommodating holes defined through the third leg extension element to lock the third leg extension element to said third leg, and

(12) a third support surface-engaging shoe pivotally attached to the third leg extension element adjacent to the second end of the third leg extension element, the third support surface engaging shoe of the third leg extension element including (A) a first mounting plate that is triangular in shape and which includes an apex and a base, (B) a second mounting plate that is triangular in shape and which includes an apex and a base, (C) a bottom element that connects the base of the first mounting plate of the third support surface-engaging shoe to the base of the second mounting plate of the third support surface-engaging shoe, the bottom element of the third support surface-engaging shoe including a first surface that is a top surface in the use condition, a second surface that is a bottom surface in the use condition, and a non-slip element on the second surface of the third support surface-engaging shoe and which is adapted to engage a ladder-supporting surface in the use condition, (D) the first mounting plate of the bottom element of the third support surface-engaging shoe being located adjacent to the first side surface of the third leg extension element and the second mounting plate of the bottom element of the third support surface-engaging shoe being located adjacent to the second side surface of the third leg extension element, and (E) a pivot pin which extends through said third leg extension element and is connected to the first mounting plate of the third support surface-engaging shoe adjacent to the apex of the first mounting plate of the third support surface-engaging shoe and to the second mounting plate of the third support surface-engaging shoe adjacent to the apex of the second mounting plate of the third support surface-engaging shoe, the pivot pin on said third leg pivotally connecting the third support surface-engaging shoe to the third leg extension element adjacent to the second end of said third leg extension element;

d) a fourth leg which is a second rear leg in the use condition and which includes (1) a first end that is a top end when said fourth leg is in the use condition, the first end of said fourth leg having a pivot pin-accommodating hole defined therethrough, (2) a second end that is a bottom end when said fourth leg is in the use condition, (3) a longitudinal axis that extends between the first end of the fourth leg and the second end of the fourth leg, (4) a first side surface, (5) a second side surface, (6) said fourth leg being hollow and having a bore defined therein, the bore of said fourth leg extending from the second end of the fourth leg toward the first end of the fourth leg in the direction of the longitudinal axis of the fourth leg, (7) a longitudinal length of the fourth leg which is measured between the first end of the fourth leg and the second end of the fourth leg, the longitudinal length of said fourth leg being less than the longitudinal length of said second leg and being equal to the longitudinal length of said third leg, (8) a first lock pin-accommodating hole defined through the first side surface of said fourth leg adjacent to the second end of said fourth leg, (9) a second lock pin-accommodating hole defined through the second side surface of said fourth leg adjacent to the second end of said fourth leg, the second lock pin-accommodating hole of said fourth leg being aligned with the first lock pin-accommodating hole of said fourth leg,

(10) a brace arm-supporting element fixedly mounted on the first side surface of said fourth leg, the brace arm-supporting element of said fourth leg including a proximal end fixedly mounted on the first side surface of said fourth leg, a body, a distal end spaced apart from the first side surface of said fourth leg, and a head on the distal end of the brace arm-supporting element of fourth leg,

(11) a fourth leg extension element telescopingly accommodated in the bore defined in said fourth leg, the fourth leg extension element including (A) a first end which is a top end when said fourth leg is in the use condition, the first end of the fourth leg extension element being located inside the bore defined in said fourth leg, (B) a second end which is a bottom end when said fourth leg is in the use condition, the second end of the fourth leg extension element being located outside the bore defined in said fourth leg, (C) a first side surface, (D) a second side surface, (E) a longitudinal axis which extends between the first end of the fourth leg extension element and the second end of the fourth leg extension element, (F) a plurality of lock pin-accommodating holes defined through the fourth leg extension element at locations on the fourth leg extension element that are spaced apart from each other in the direction of the longitudinal axis of the fourth leg extension element, each of the lock pin-accommodating holes defined in the fourth leg extension element being adapted to be aligned with the first and second lock pin-accommodating holes defined through the first and second side surfaces of said fourth leg, and (G) a fourth leg extension element lock pin which is adapted to extend through the first and second lock pin-accommodating holes defined through the first and second side surfaces of said fourth leg and through a selected one of the plurality of lock pin-accommodating holes defined through the fourth leg extension element to lock the fourth leg extension element to said fourth leg, and

(12) a fourth support surface-engaging shoe pivotally attached to the fourth leg extension element adjacent to the second end of the fourth leg extension element, the fourth support surface-engaging shoe of the fourth leg extension element including (A) a first mounting plate that is triangular in shape and which includes an apex and a base, (B) a second mounting plate that is triangular in shape and which includes an apex and a base, (C) a bottom element that connects the base of the first mounting plate of the fourth support surface-engaging shoe to the base of the second mounting plate of the fourth support surface engaging element, the bottom element of the fourth support surface-engaging shoe including a first surface that is a top surface in the use condition, a second surface that is a bottom surface in the use condition, and a non-slip element on the second surface of the fourth support surface-engaging shoe and which is adapted to engage a ladder-supporting surface in the use condition, (D) the first mounting plate of the bottom element of the fourth support surface-engaging shoe being located adjacent to the first side surface of the fourth leg extension element and the second mounting plate of the bottom element of the fourth support surface-engaging shoe being located adjacent to the second side surface of the fourth leg extension element, and (E) a pivot pin which extends through said fourth leg extension element and is connected to the first mounting plate of the fourth support surface-engaging shoe adjacent to the apex of the first mounting plate of the fourth support surface-engaging element and to the second mounting plate of the fourth support surface-engaging shoe adjacent to the apex of the second mounting plate of the fourth support surface-engaging shoe, the pivot pin on said fourth leg pivotally connecting the fourth support surface-engaging shoe to the fourth leg extension element adjacent to the second end of said fourth leg extension element;

e) a first brace element which includes (1) a proximal end pivotally attached to said first leg by the pivot fastener on said first leg, (2) a distal end, (3) a longitudinal axis which extends between the proximal end of said first brace element and the distal end of said first brace element, (4) a first side edge, (5) a second side edge, (6) a plurality of notches defined in said first brace element adjacent to the first side edge, the plurality of notches being spaced apart from each other in the direction of the longitudinal axis of said first brace element, (7) a lock notch defined in said first brace element adjacent to the distal end of said first brace element and adjacent to the second side edge of said first brace element, (8) said first brace element being pivotal between a use position extending between said first and third legs and a stored position in which the longitudinal axis of said first brace element extends in the direction of the longitudinal axis of said first leg, (9) the lock notch of said first brace element being located and sized to engage the brace storage pin on said first leg when said first brace element is in the stored position, and

(10) each notch of the plurality of notches of said first brace element being sized to engage the brace-supporting element on said third leg;

f) a second brace element which includes (1) a proximal end pivotally attached to said second leg by the pivot fastener on said second leg, (2) a distal end, (3) a longitudinal axis which extends between the proximal end of said second brace element and the distal end of said second brace element, (4) a first side edge, (5) a second side edge, (6) a plurality of notches defined in said second brace element adjacent to the first side edge of said second brace element, the plurality of notches of said second brace element being spaced apart from each other in the direction of the longitudinal axis of said second brace element, (7) a lock notch defined in said second brace element adjacent to the distal end of said second brace element and adjacent to the second side edge of said second brace element, (8) said second brace element being pivotal between a use position extending between said second and fourth legs and a stored position in which the longitudinal axis of said second brace element extends in the direction of the longitudinal axis of said second leg, (9) the lock notch of said second brace element being located and sized to engage the brace storage pin on said second leg when said second brace element is in the stored position, and

(10) each notch of the plurality of notches of said second brace element being sized to engage the brace-supporting element on said fourth leg;

g) a top unit which includes (1) a planar body having a peripheral edge, (2) a plurality of tool-accommodating holes defined through the planar body, (3) a skirt on the peripheral edge of the planar body, the skirt including a front section, a rear section, a first end section and a second end section, (4) a first pivot pin-accommodating hole defined through the first end section of the skirt adjacent to the front section of the skirt, (5) a second pivot pin-accommodating hole defined through the first end section of the skirt adjacent to the rear section of the skirt, (6) a third pivot pin-accommodating hole defined through the second end section of the skirt adjacent to the front section of the skirt, and (7) a fourth pivot pin-accommodating hole defined through the second end section of the skirt adjacent to the rear section of the skirt;

h) a first pivot pin which extends through the first pivot pin-accommodating hole of the skirt of said top unit and through the pivot pin-accommodating hole defined in said first leg adjacent to the first end of said first leg, said first leg being pivotally attached to said top unit by said first pivot pin;

i) a second pivot pin which extends through the second pivot pin-accommodating hole in the skirt of said top unit and through the pivot pin-accommodating hole defined in said third leg adjacent to the first end of said third leg, said third leg being pivotally attached to said top unit by said second pivot pin;

j) a third pivot pin which extends through the third pivot pin-accommodating hole of the skirt of said top unit and through the pivot pin-accommodating hole defined in said third leg adjacent to the first end of said third leg, said third leg being pivotally attached to said top unit by said third pivot pin;

k) a fourth pivot pin which extends through the fourth pivot pin-accommodating hole of the skirt of said top unit and through the pivot pin-accommodating hole defined in said fourth leg adjacent to the first end of said fourth leg, said fourth leg being pivotally attached to said top unit by said fourth pivot pin;

l) a plurality of ladder steps which extend between said first leg and said second leg, each ladder step including a first surface which is a top surface in the use condition and a non-slip element on the top surface of each ladder step;

m) a work support unit pivotally attached to said third leg and to said fourth leg, said work support unit including a plurality of tool accommodating holes defined therethrough and a support area that is sized to securely support and encircle a one gallon paint can;

n) a first tether having a proximal end fixedly secured to said third leg and a distal end fixedly secured to the third leg extension element lock pin;

o) a second tether having a proximal end fixedly secured to said fourth leg and a distal end fixedly secured to the fourth leg extension element lock pin;

p) a plurality of ladder steps fixedly secured to said first and second legs; and q) a non-slip element fixedly mounted on each ladder step.

* * * * *